United States Patent [19]

Mullen

[11] 4,141,271

[45] Feb. 27, 1979

[54] METHOD AND APPARATUS FOR PREVENTING IMPROPER STRING RETURN

[76] Inventor: Delmar E. Mullen, 7061 Newport St., Commerce City, Colo. 80022

[21] Appl. No.: 719,379

[22] Filed: Sep. 1, 1976

[51] Int. Cl.[2] ..... G10D 3/14

[52] U.S. Cl. ..... 84/312 P; 84/205; 84/297 R; 84/304; 84/313

[58] Field of Search ..... 84/200, 205, 207, 297 R, 84/312 R, 312 P, 313

[56] References Cited

U.S. PATENT DOCUMENTS

| | | | |
|---|---|---|---|
| 475,674 | 5/1892 | Cook | 84/297 R |
| 2,828,660 | 4/1958 | Paulsen | 84/312 |
| 3,596,552 | 8/1971 | Lager | 84/207 |

FOREIGN PATENT DOCUMENTS

| | | | |
|---|---|---|---|
| 10668 of | 1845 | United Kingdom | 84/205 |

*Primary Examiner*—Lawrence R. Franklin
*Attorney, Agent, or Firm*—John R. Ley

[57] ABSTRACT

This method and apparatus prevents improper string return by restraining an end portion of a string of a stringed instrument, such as a pedal steel guitar, free of longitudinal movement with changes in tension of the string from a predetermined level of string tension. The invention also involves applying tension force to the string operatively collinearly with a linear projection of an end portion of the string while maintaining an end portion of the string free of longitudinal movement with changes in string tension from a predetermined level of string tension.

7 Claims, 9 Drawing Figures

METHOD AND APPARATUS FOR PREVENTING IMPROPER STRING RETURN

BACKGROUND AND SUMMARY OF THE INVENTION

The invention relates to stringed instruments, and more particularly, to string tuning means and method for securing an end portion of a string of a stringed instrument in a manner to prevent improper string return.

In stringed instruments of the pedal steel guitar type, the tension of any of the strings may be selectively increased or decreased from a predetermined normal level as the musician plucks the strings, thereby providing great versatility in the tones and characteristics of the music produced. A problem accompanying these string tension changes is that the string does not return to its predetermined normal tension level after the selective tension or tone change, thereby creating a slight out-of-tune condition. After the string tension is increased or raised, the string typically returns slightly flat in tone, meaning the tension level is slightly less than the predetermined level. After the string tension is decreased or lowered, the string typically returns slightly sharp in tone, meaning the tension level is slightly more than the predetermined level. This problem, called improper string return, has been particularly distressing to accomplished steel guitar musicians because the quality of their music has suffered as a result of deficiencies in the instrument.

The effects of the problem of improper string return are readily understood, as is exemplified by articles at page 3 of Pedal Steel Newsletter No. 6 of 1976 and at page 8 of Steel Guitar Record Club Newsletter No. 5 of 1976. However, the major cause of improper string return has heretofore been essentially unknown. Furthermore, since a major cause of the problem was essentially unknown, no highly effective solution to the problem has been available.

The general object of the present invention is to provide a highly effective solution to the problem of improper string return in stringed instruments, particularly those of the pedal steel guitar type. It is another object of the present invention to make use of an accurate understanding of the cause of improper string return in providing a highly effective solution to this problem. It is still a further object of this invention to provide an apparatus and a method for securing a string to a stringed instrument in a manner which provides a highly effective solution to the problem of improper string return.

In accordance with the present invention, generally summarized here, there is provided a method and apparatus for restraining an end portion of a string of a stringed instrument free of longitudinal movement with changes in tension of the string from a predetermined level of string tension. The invention also involves the application of tension force to a string operatively collinearly with a linear projection of an extended end portion of the string while maintaining an end portion of the string free of longitudinal movement with changes in string tension from a predetermined level of string tension. The invention is particularly adapted for use with stringed instruments of the pedal steel guitar type wherein selective changes in the tension of the strings are usual.

A more complete understanding of the invention may be obtained from the following detailed description of the invention and brief description of the drawings.

DETAILED DESCRIPTION OF THE INVENTION

Figure 1:
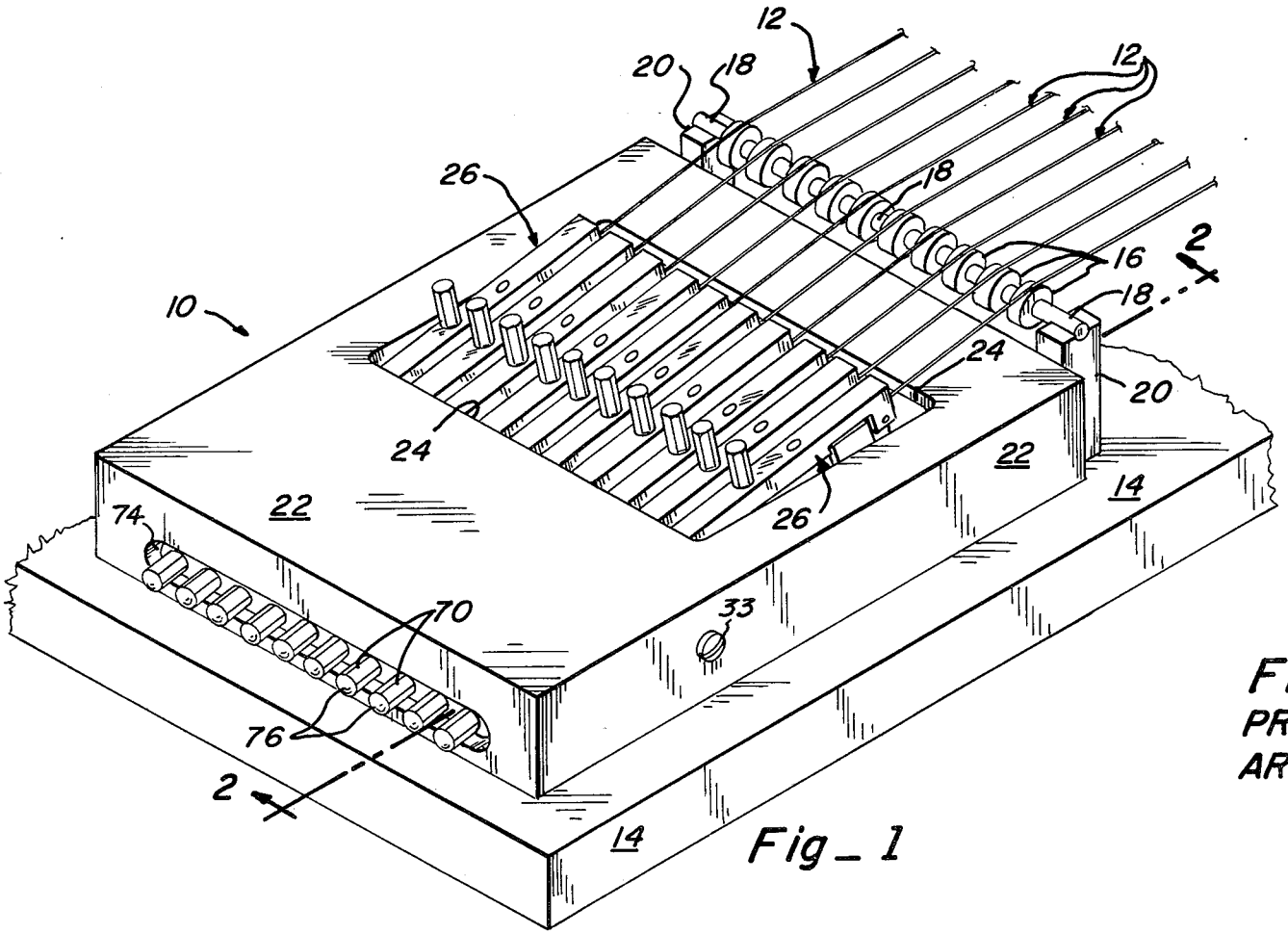
FIG. 1 is a perspective view of a presently preferred embodiment of the invention and of certain exemplary portions of a stringed instrument of the pedal steel guitar type.

A presently preferred embodiment of apparatus of the present invention, generally referenced 10 in FIG. 1, is intended to be advantageously substituted for a conventional key-type string tuning head to secure or operatively connect end portions of strings 12 to a stringed instrument, such as a pedal steel guitar of which a portion of a frame member 14 is representative. As is well known in the art, pedal steel guitars involve tone changer means connected to the other ends of the strings (not shown) for effecting selective increases and decreases in the tension of one or more of the strings from a predetermined level of string tension, thereby producing a wide variety of tones. A plurality of nut roller members 16, carried by a shaft 18 attached to the frame member 14 by brackets 20, are attached adjacent the apparatus 10 to contact and support the ends of strings 12. Use and construction of nut roller members is conventional in the art. Shown in FIG. 1, the portions of strings 12 to the right of the nut roller members 16 extend in a plane above the frame member 14 and vibrate to produce musical tones, and the end portions of strings 12 to the left of the nut roller members slope downward to connect to the apparatus 10.

Apparatus 10 comprises an outside housing member 22 having an opening 24 therein through which a plurality of string tuning head apparatus or means 26 partially protrudes. Each string tuning head means is for operatively connecting an end portion of one string 12 to the instrument and for preventing significant amounts of improper string return with tension changes from the predetermined level of string tension. Each string tuning head means is also for adjusting the normal level of string tension as will become more apparent from the subsequent description.

Figure 4:
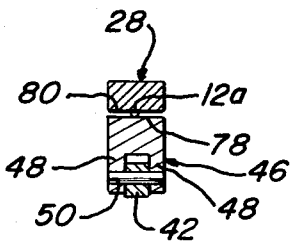
FIG. 4 is an end elevational view taken along Section 4—4 of FIG. 2.
Figure 3:
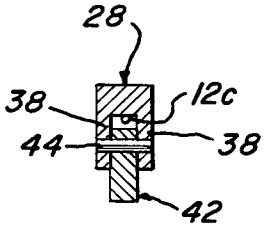
FIG. 3 is an end elevational view taken along Section 3—3 of FIG. 2.
Figure 2:
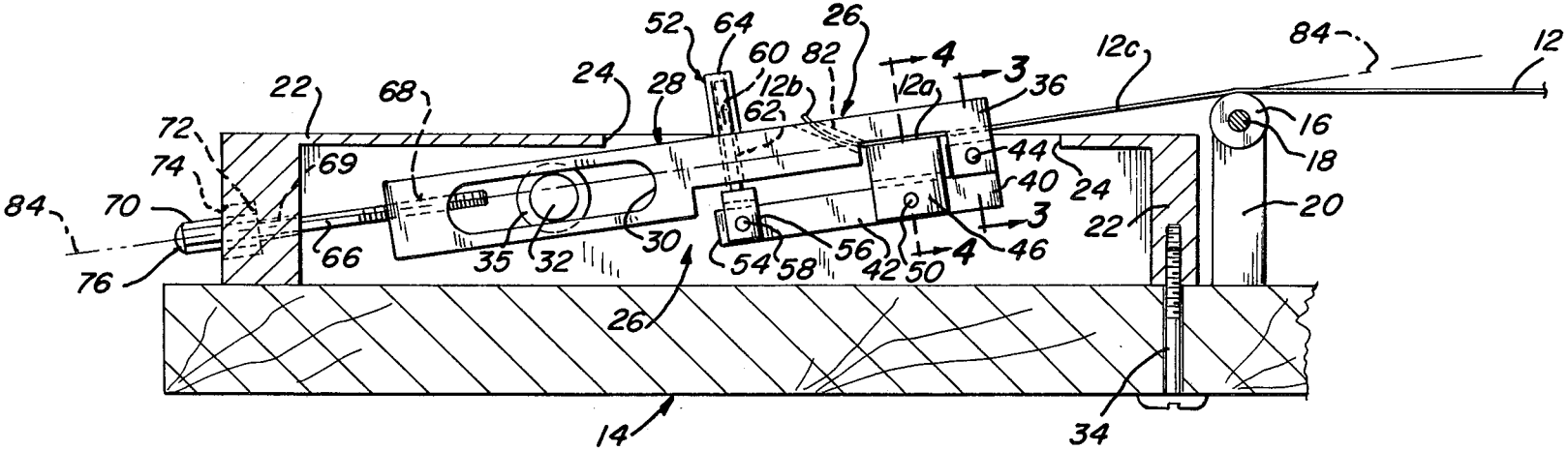
FIG. 2 is a side elevational view taken along Section 2—2 of FIG. 1.

The string tuning head means 26 are better understood from FIGS. 2, 3 and 4, and each includes an elongated main attachment member 28 having an elongated opening 30 formed therein for receiving a shaft 32. Shaft 32 extends transversely of apparatus 10 and is secured to the housing member 22 by screws 33 (FIG. 1). Housing member 22 is attached to the frame member 14 by screws 34. Washers 35 on shaft 32 separate transversely adjacent main attachment members 28. End 36 of member 28 includes two downward extending tabs 38 (FIG. 3) between which an end portion 40 of a clamping level member 42 is pivotably connected by means of a pin 44. A clamping block member 46 includes two downward extending tabs 48 (FIG. 4) between which a middle portion of the lever member 42 is received. A pin 50 pivotably connects the block member 46 to the lever member 42. A clamping screw member 52 is operatively connected to the other end 54 of the lever member 42, and comprises an end piece 56 connected by pin 58 to the lever member 42 and a threaded shank 60 connected to the end piece 56 and extending through a bore 62 in the main attachment member 28. A nut member 64 is threaded onto the portion of shank 60 extending above the main attachment member 28.

A threaded end portion of a tension screw member 66 is threaded into a threaded bore 68 in the main attachment member 28. The screw member 66 extends through bore 69 out of the housing member 22. A sleeve 70 fits between a surface 72 of an opening 74 in the housing member 22 and a head 76 of screw member 66.

In FIGS. 2 and 4, an end portion **12*a* of string 12 is clamped or laterally restrained between a top surface 78 of clamping block member 46 and surface portion 80 of the main attachment member 28. When nut member 64 is tightened on threaded shank 60, the clamping lever member 42 is pivoted about pin 44 toward the main attachment member 28, and the clamping block member 46 moves transversely of the member 28 to laterally squeeze string end portion 12*a* between surfaces 78 and 80. Surfaces 78 and 80 are hardened to resist indentions and grooves as a result of the high laterally applied forces on the string end portion 12*a*. High lateral forces are delivered to string end portion 12*a* as a result of the mechanical advantages of the thread action of the nut member 64 on shank 60 and the location of the various pivoting points at pins 44, 50 and 58 on lever member 42. Thus described are forms of string clamping means for applying restraining force to the connected string end portion 12*a* and connection means for connecting with the end portion 12*a* of the string 12. A bore 82 in member 28 is provided for an unused end portion 12*b* of string 12**. The elements described may be constructed of suitable metal materials.

An end portion **12*c* of string 12 is next adjoining the connected or restrained end portion 12*a*, and end portion 12*c* extends longitudinally to the nut roller member 16 when tension has been established in string 12. Tension is established by movement of the string tuning head means 26 to the left and slightly downward in FIG. 2, which is accomplished by rotation of screw member 66. Applying turning force on the head 76 rotates screw member 66, pulling the main attachment member 28 to the left and downward along the axis of screw member 66 as a result of thread action in bore 68. The opening 30 being oblong and slightly greater in transverse dimension than the diameter of shaft 32 allows uninhibited movement of member 28 leftward and downward. As the restrained string end portion 12*a* moves to the left, tension in string 12 is created after all of the slack in the string has been removed. Rotation of the tension screw member 66 thus establishes tension in string 12 and allows adjustment of a desired predetermined level of tension in the string to tune the string to vibrate at a desired normal tone. Shaft 32 supports member 28 and prevents it from becoming inaccessible when there is no tension in string 12 or when no string is attached to means 26**.

As tension in string 12 is established, as is the condition shown in FIG. 2, the tension force from the screw member 66 is supplied to member 28 and an end portion of string 12 collinearly with and along a centerline 84 through the axis of screw member 66. The elements of the string tuning head means 26 are arranged to apply the string tension force of screw member 66 operatively collinearly with a linear projection through the longitudinally extended string end portion **12*c*, as can be understood as a result of the centerline 84 extending through both the axes of string end portion 12*c* and screw member 66. In addition, the laterally restrained string end portion 12*a* may also be collinear with the centerline 84. Other arrangements may be employed to create the string tension, but the force for creating tension in the string must be effectively and operatively applied collinearly along a linear projection (centerline 84) of a longitudinally extended string end portion of string 12. Thus described is one form of means for applying tension force in the string 12 operatively collinearly with a linear projection of an end portion of string 12**.

The previously described string clamping means involving the clamping block member 46 is one form of restraining means for restraining an end portion **12*a* of the string 12 free of longitudinal movement with changes in tension in the string from its predetermined level. This restraint is achieved as a result of the high lateral force on string end portion 12*a* which prevents any substantial slippage of string end portion 12*a* along surfaces 78 and 80**. It has been determined that improper string return is caused by slight longitudinal movements of the string end portion where it is secured to the instrument, and that such longitudinal movement is inherent in bends, turns, loops, coils and the like in the string commonly involved in securing the string end portion to the instrument.

Figure 5:
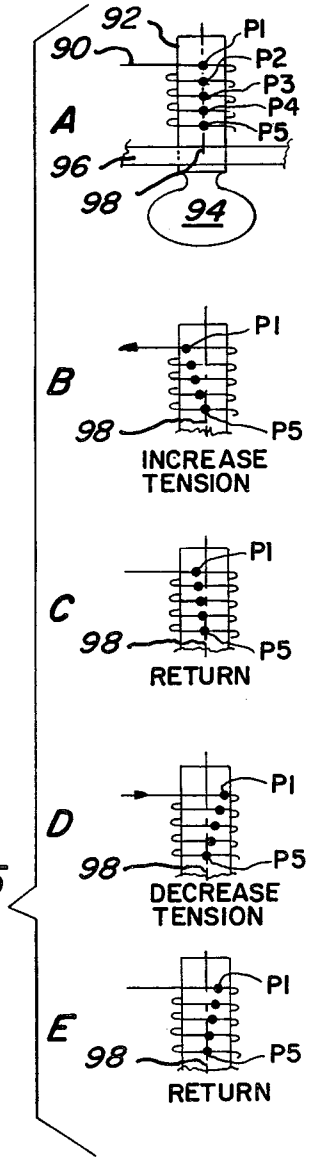
Fig 5 PRIOR ART
FIGS. 5A through 5E represent diagrammatic representations of the prior art, FIG. 5A being an exemplary tuning key and string and FIGS. 5B to 5E being enlarged schematic diagrams illustrating a typical cause of improper string return.

An understanding of the cause of improper string return may be obtained by reference to FIG. 5. In FIG. 5A a string 90 of a stringed instrument is wrapped or coiled around a shank 92 of a conventional tuning key 94 rotatably retained by a portion 96 of conventional tuning key head. Such an arrangement is conventional and commonly employed in pedal steel guitars. A number of points P1 to P5 have been designated along a centerline 98 through shank 92 to represent points of reference on each of the coils of the string 90 on shank 92 after the predetermined level of tension in the string has been established. When the string tension is increased as shown in FIG. 5B, each of the coils turns slightly on shank 92 due to the increase in tension in the string. The result is that at least the upper points on the string including P1 have twisted to the left of centerline 98. When the tone changer releases or returns the string in FIG. 5C, the normal predetermined level of string tension does not result because a resistance coiling effect of the string coils on shank 92 prevents the upper point P1 from returning to its position on the centerline 98. The points on some other coils also may not fully return to the centerline. The effect is that the tension in string 90 is slightly less than the predetermined level since point P1 has not returned to its original centerline position, thus causing a slightly flat tone when the string returns after its tension has been increased.

A similar situation results when the tension is decreased. FIG. 5D illustrates how each of the coils on shank 92 has uncoiled when the string tension has decreased since at least the upper points of reference are to the right of centerline 98. Upon string return shown in FIG. 5E, the point P1 on the upper coil does not fully return to the centerline position, thus causing a slight increase in string tension above its normal level and causing the tone upon string return to be slightly sharp.

The present invention avoids this string return problem by maintaining the restrained end of the string free of longitudinal movement with string tension changes due to the high, laterally applied restraining force. Furthermore, it is believed that bends, turns or the like adjoining the connected string end portion may have a similar effect as coils on a tuning key shank. For this reason, application of the tension force collinearly with a linear projection of an end portion of the string avoids any turns or bends.

The apparatus of the present invention can thus be understood to be one form of means for preventing significant improper string return. From the foregoing description it is apparent that the invention may also involve a method of securing a string to a stringed instrument to prevent significant improper string return.

An illustrative and presently preferred embodiment of the inventive concepts has been described hereinbefore, but it is to be understood that the appended claims are to include alternative embodiments except insofar as limited by the prior art.

What is claimed is:

1. A method of avoiding significant improper string return by securing an end of a string to one end of a stringed instrument, the stringed instrument being of the type including tension changing means at the other end of the instrument operatively connected to the other end of the string for effecting selected and repeated increases and decreases in string tension from a predetermined normal string tension level during playing of the instrument, said inventive method comprising the steps of:

selecting an end of the string opposite the end of the string connected to the tension changing means, said selected end of the string being essentially of uniform diameter therealong and free of any significant external protuberances extending therefrom;

apportioning the selected end of the string into an outermost first portion and a next inwardly adjacent second portion, the first and second portions of the string and each having a selected elongated length;

extending the first portion of the selected string end essentially linearly along its length;

extending the second portion of the selected string end essentially linearly along its length;

extending the first and second portions of the selected string end essentially colinearly along their lengths with respect to one another;

applying restraining force on opposite transverse sides and over substantially only the total length of the linearly extending first portion of selected string end, the restraining force being applied to the string essentially only perpendicularly with respect to the colinear extension of the first and second portions, and the restraining force being of sufficient magnitude of restrain the first portion of the selected string end against longitudinal movement under application of the predetermined level of string tension and under the selective increases and decreases in string tension from the predetermined level;

applying tension creating force in the string operatively at the first portion of the selected string end, the tension creating force being applied from the end of the stringed instrument at a point thereon operatively colinearly with a linear projection of the first and second portions of the selected string end, the tension creating force determining the predetermined level of string tension;

repeatedly selectively changing the tension of the string from the predetermined level; and allowing the string tension to return to the predetermined level after each tension change.

2. A method as recited in claim 1 wherein the string includes an elongated middle portion extending from the second portion of the selected string end toward the end of the string operatively connected to the tension changing means, the middle portion of the string vibrating to produce musical tones, said inventive method further comprising the steps of:

providing a support member extending from the instrument;

contacting a point on the string with the support member, the point on the string contacting the support member being the point at which the second portion of the selected string end adjoins the middle portion of the string;

angling the first and second portions of the selected end of the string at an angle with respect to the middle portion of the string; and minimizing the angle of the first and second portions of the selected string end with respect to the middle portion of the string, the minimum angle being that angle which adequately contacts the point on the string with the support member to essentially terminate vibrations of the middle portion of the string at the support member.

3. A method as recited in claim 1 wherein the steps of applying tension creating force and restraining force to the first portion of the selected string end operatively comprise the steps of:

providing an elongated main attachment member;

providing a clamping block member operatively connected to the main attachment member for transverse movement theretoward, said clamping block member being operative upon transverse movement toward the main attachment member to apply restraining force on opposite transverse sides of the first portion of the selected string end; and providing an elongated tension adjusting member operatively extending from said main attachment member essentially colinearly with respect to the first and second portions of the selected string end.

4. Apparatus for securing an end of a string to a stringed instrument, comprising in combination:

an elongated main attachment member adapted to be operatively connected to the stringed instrument, said main attachment member having a first end and a straight surface portion spaced from and extending to the first end;

an elongated clamping level member having first and second oppositely positioned ends;

means for pivotably connecting the first end of said clamping lever member to the first end of said main attachment member, said pivotably connecting means also positioning the first ends of said main attachment member and said clamping lever member in transversely spaced-apart relation, the transversely spaced-apart relation defining an opening adjoining the straight surface portion of said main attachment member through which an end of the string is received;

a clamping block member having a straight surface portion;

means for operatively connecting said clamping block member to said clamping level member at a position intermediate the first and second ends of said clamping lever member and for positioning the straight surface portion of said clamping block member in longitudinally parallel and transverse confronting relation with the straight surface portion of said main attachment member upon pivoting of said clamping level member to a position adjacently transversly spaced from said main attachment member;

clamping means operatively connected essentially transversely between the second end of said clamping lever member and said main attachment member, said clamping means for operatively pivoting said clamping lever member toward a position adjacently transversely spaced from said main attachment member and adapted for operatively creating laterally applied restraining force on opposite transverse sides of a string positioned between the confronting straight surface portions of said main attachment member and said clamping block member.

5. Apparatus as recited in claim 4 further comprising in combination:

a shaft member operatively connected to extend transversely from said main attachment member;

a housing member adapted to be connected to the stringed instrument; and means operatively connecting the shaft member to the housing member.

6. Apparatus as recited in claim 5:

wherein said elongated main attachment member further comprises a second end positioned oppositely along said main attachment member from the first end; and further comprising tension means operatively connected between the housing member and the second end of said main attachment member, said tension means operatively applying tension force to the string colinearally with a portion of the string restrained between the confronting straight surface portions of said main attachment member and said clamping block member.

7. Apparatus as recited in claim 4 wherein said clamping means comprises a screw member connected between the second end of said clamping lever member and said main attachment member.

* * * * *